United States Patent [19]

Kobayashi et al.

[11] 4,291,120

[45] Sep. 22, 1981

[54] HEAT DEVELOPABLE PHOTOSENSITIVE MATERIAL

[75] Inventors: Tomoyuki Kobayashi; Toshimasa Usami, both of Asaka; Hiroshi Misu; Hidefumi Sera, both of Minami-ashigara, all of Japan

[73] Assignee: Fuji Photo Film Co., Ltd., Kanagawa, Japan

[21] Appl. No.: 121,855

[22] Filed: Feb. 15, 1980

[30] Foreign Application Priority Data

Feb. 15, 1979 [JP] Japan ..... 54-16341

[51] Int. Cl.[3] ..... G03C 1/02

[52] U.S. Cl. ..... 430/531; 430/618; 430/619; 430/620; 430/964; 430/536; 430/961

[58] Field of Search ..... 430/617, 618, 619, 620, 430/964, 531; 536, 961

[56] References Cited

U.S. PATENT DOCUMENTS 3,877,942 4/1975 Nagatomo et al. ..... 430/961

*Primary Examiner*—Won H. Louie, Jr.

*Attorney, Agent, or Firm*—Sughrue, Mion, Zinn, Macpeak & Seas

[57] ABSTRACT

A heat developable photosensitive material having two or more layers superimposed on a support and containing at least (a) an organic silver salt, (b) a photocatalyst and (c) a reducing agent in one or more such layers, at least one said layers containing (d) a polymer having a repeating unit of the formula:

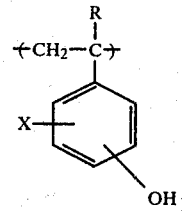

wherein R is a hydrogen atom or a lower alkyl group; and X is a hydrogen atom, or one to three groups selected from the group consisting of a halogen atom, a nitro group, a cyano group, an alkyl group, an alkoxy group, an alkoxycarbonyl group, an alkylsulfonyl group, an aryloxy group, an acyl group, an acyloxy group and an acylamido group.

12 Claims, No Drawings

HEAT DEVELOPABLE PHOTOSENSITIVE MATERIAL

BACKGROUND OF THE INVENTION

1. Field of the Invention

This invention relates to a heat developable photosensitive material and more particularly to a heat developable photosensitive material having a laminated structure with improved contact between each layer.

2. Description of the Prior Art

A heat developable photosensitive material is a photographic material that can be dry-processed without using any liquid. As illustrated in U.S. Pat. Nos. 3,152,904 and 3,457,075, the essential components of the material are an organic silver salt such as silver behenate, a reducing agent for the organic silver salt, and a photocatalyst such as silver halide that releases, upon exposure to light, a substance which serves as a catalyst for the reaction between the organic silver salt and the reducing agent under heating. Such a photographic material is stable at ordinary temperatures but when it is heated to a temperature of at least 80° C., preferably at least 100° C., after imagewise exposure, the oxidation-reduction reaction between the organic silver salt (oxidizing agent) and the reducing agent in the photosensitive layer occurs as catalyzed by an exposed photocatalyst in proximity with the agents, and the resulting silver causes the exposed area of the photosensitive layer to rapidly darken to provide an image having contrast with the unexposed area (background).

The simplest construction of a heat developable photosensitive material comprises a support having coated thereon a single layer containing all the stated essential components. But in most practical applications, each component is incorporated in a separate layer to prevent it from entering into dark reaction with other essential components or other additives (e.g., toner). Alternatively, as taught in Japanese Patent Application (OPI) No. 87721/78 (the term "OPI" as used herein refers to a "published unexamined Japanese patent application"), a subbing layer is disposed between the support and the single layer to prevent heat fogging, or as described in Japanese Patent Application (OPI) No. 6917/74 (U.S. Pat. No. 3,933,508), a polymer overcoat is disposed to increase the transparency of the film or improve its keeping quality with time.

However, it was found that due to poor contact between each layer of the laminated structure, two adjacent layers easily peeled from each other, resulting in a defect called "delamination". The phenomenon of poor adhesion of laminated layers has been studied for many years in the art of common gelatin-silver halide photographic sensitive materials, but in the field of heat developable photosensitive materials, this is a new problem and few prior art references suggest a solution to it.

In some cases, delamination in a heat developable photosensitive material occurs during heat development due to a heat developing machine using a dirty developing rollers and, in other cases, it occurs when a pressure sensitive adhesive tape used to attach a heat developed photosensitive material to the wall is peeled from the wall. The defect is developed in the interface of any two layers of the heat developable photosensitive material, but the interface between the polymer overcoat and a layer beneath it is most susceptible to such defect. Delamination results in a broken copy image or the least legible image.

SUMMARY OF THE INVENTION

Therefore, one object of this invention is to provide a heat developable photosensitive material having a laminated structure with improved contact between each layer and which is free from delamination.

Another object of this invention is to provide a heat developable photosensitive material having a polymer overcoat which does not peel from the layer beneath it.

A further object of this invention is to provide a heat developable photosensitive material from which delamination has been eliminated by a means that will not have any adverse effect on other photographic characteristics.

This invention achieves these objects by a heat developable photosensitive material having two or more layers superimposed on a support and containing at least (a) an organic silver salt, (b) a photocatalyst and (c) a reducing agent in one or more such layers, at least one of said layers containing (d) a polymer having a repeating unit of the formula:

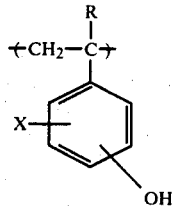

wherein R is a hydrogen atom or a lower alkyl group; and X is a hydrogen atom, or one to three groups selected from the class consisting of a halogen atom, a nitro group, a cyano group, an alkyl group, an alkoxy group, an alkoxycarbonyl group, an alkylsulfonyl group, an aryloxy group, an acyl group, an acyloxy group and an acylamido group.

DETAILED DESCRIPTION OF THE INVENTION

The organic silver salt used as component (a) of this invention is colorless, white or pale in a normal state, but when heated to a temperature of at least 80° C. in the presence of an exposed photocatalyst (to be described hereinafter), it reacts with a reducing agent (also to be described hereinafter) to form a silver (image). Therefore, the salt functions as an image forming component in a heat developable photosensitive material. Known examples of such organic silver salt are silver salts of organic compounds having an imino group, a mercapto group, a thion group or a carboxyl group. Illustrative specific organic silver salts include the following:

(1) silver salts of organic compounds having an imino group such as benzotriazoles, phthalazinones, benzoxazinediones, imidazoles, tetrazaindenes and pentazaindenes;

(2) silver salts of organic compounds having a mercapto or thion group such as 2-mercaptobenzoxazoles, mercaptoxadiazoles, 2-mercaptobenzothiazoles, 2-mercaptobenzoimidazoles, 3-mercapto-4-phenyl-1,2,4-triazoles and 3-(2-carboxyethyl)-4-oxymethyl-4-thiapline-2-thions; and (3) silver salts of organic compounds having a carboxyl group such as aliphatic carboxylic acids, aromatic carboxylic acids, for example, silver benzoate, silver phthalate, silver phenyl acetate and silver 4'-n-octadecyloxydiphenyl-4-carboxylate.

More specific examples of these organic silver salts and other examples of organic silver salts are disclosed in U.S. Pat. Nos. 3,457,075, 3,549,379, 3,785,830, 3,933,507 and 4,009,039, British Pat. No. 1,230,642, and Japanese Patent Application (OPI) Nos. 93139/75, 99719/75, 22431/76 (U.S. Pat. No. 4,009,039), 141222/77 and 36224/78. A suitable organic silver salt may be selected from the list of these known organic silver salts and be used as component (a). For instance, when silver halide or silver-dye photosensitive complex is used as a photocatalyst, known organic silver salts relatively resistant to light are selected. Preferred examples of such organic silver salts are those of long chain aliphatic carboxylic acids having 10 to 40 carbon atoms, preferably 18 to 33 carbon atoms, and illustrative salts of long chain aliphatic carboxylic acids include silver laurate, silver myristate, silver palmitate, silver stearate, silver arachidate, silver behenate, silver lignocerate, silver pentacosanoate, silver cerotate, silver heptacosanoate, silver montanate, silver melissate and silver laccerate.

These organic silver salts may be synthesized by various known methods described in U.S. Pat. Nos. 3,457,075, 3,458,544, 3,700,458, 3,839,049 and 3,960,908, British Pat. No. 1,173,426, and Japanese Patent Application (OPI) Nos. 52626/74, 122011/76 and 14122/77. The polymers mentioned in U.S. Pat. No. 3,700,458 and Japanese Patent Application (OPI) No. 32015/78 or the metal-containing compounds mentioned in U.S. Pat. No. 3,887,597 and Japanese Patent Application (OPI) Nos. 13224/74 and 41317/76 are preferably present in the reaction system for the formation of organic silver salts because they provide organic silver salts having improved grain shape, grain size and/or photographic properties. Such polymers are preferably used in an amount of about 0.1 g to about 1,000 g, especially from about 1 g to about 500 g, per mol of the organic silver salt, and the metal-containing compounds are preferably used in an amount of $10^{-6}$ mol to $10^{-1}$ mol per mol of the organic silver salt.

The grains of the thus prepared organic silver salt preferably have a major axis of from about 0.01 micron to about 10 microns, and a grain size of from about 0.1 micron to about 5 microns is particularly preferred.

The organic silver salt component (a) is incorporated in the photographic material of this invention in an amount of from about 0.1 g to about 4 g, preferably from about 0.2 to about 2.5 g in terms of silver per square meter of the support. This range is necessary and sufficient for providing a suitable image density. Using less than 0.1 g of the organic silver salt does not provide an adequate image density and using more than 4 g of the salt simply adds to the production costs without increasing the image density.

The photocatalyst used as component (b) in this invention has the ability to be converted, upon exposure to electromagnetic radiation, to a substance that catalyzes the reaction between the organic silver salt of component (a) and the reducing agent of component (c) at an elevated temperature of at least 80° C. for the formation of silver (image), or the ability to release such substance upon said exposure. This component functions both as a photosensitive component for a heat developable photosensitive material and as a catalytic component for the reaction for silver (image) formation. Examples of such photocatalyst include zinc oxide, titanium oxide and other inorganic photoconductive materials; the salt of heavy metal and diazosulfonic acid or sulfinic acid described in U.S. Pat. No. 3,152,904; and/or the photosensitive complex comprising silver and dye described in Japanese Patent Publication No. 25498/74, Japanese Patent Application (OPI) No. 4728/71 and U.S. Pat. No. 3,933,507 and the photosensitive silver halide described in U.S. Pat. No. 3,457,075. Such photocatalysts are generally used in an amount of from about 0.001 to about 10 mols, preferably from about 0.01 mol to about 1 mol, per mol of the organic silver salt.

Photocatalysts most suitable for use in this invention are photosensitive silver halides such as silver chloride, silver bromide, silver iodide, silver chlorobromoiodide, silver chlorobromide, silver chloroiodide, silver iodobromide or mixtures thereof. The photosensitive silver halides preferably have a grain size of from about 0.001 micron to about 2 microns, particularly preferably from about 0.01 micron to about 0.5 micron. They are used in an amount of from about 0.001 mol to about 0.7 mol, preferably from about 0.01 mol to about 0.5 mol, per mol of the organic silver salt.

The photosensitive silver halide is prepared as, say, a Lippmann emulsion, an ammoniacal emulsion, a thiocyanate or thioether ripened emulsion by the single jet, double jet, and any other method known in the photographic art, before they are incorporated in the composition of this invention in the form of an admixture with the other essential components of this invention. For providing high sensitivity, adequate contact may be formed between the organic silver salt and photosensitive silver halide by using polymers other than gelatin such as polyvinyl acetals described in U.S. Pat. Nos. 3,706,564, 3,706,565, 3,713,833 and 3,748,143, and British Pat. No. 1,362,970 as a protective polymer for the preparation of a photosensitive silver halide emulsion; by decomposing the gelatin of a photosensitive silver halide emulsion with an enzyme as taught in British Pat. No. 1,354,186; or by preparing photosensitive silver halide grains in the presence of a surfactant, as described in U.S. Pat. No. 4,076,539, thereby omitting the use of a protective polymer.

Alternatively, the photosensitive silver halide used in this invention may be prepared by the method described in British Pat. No. 1,447,454 wherein a reaction system containing both a halogenating agent and an organic silver salt forming component (e.g., sodium behenate) is injected with a silver ion-containing solution to thereby form a photosensitive silver halide almost simultaneously with the formation of an organic silver salt.

According to still another method, a separately prepared solution or dispersion of an organic silver salt or a sheet material containing the salt is acted upon by a photosensitive silver halide forming component to convert a part of the organic silver salt to photosensitive silver halide. The thus formed photosensitive silver halide is in effective contact with the organic silver salt to provide a preferred activity. The "photosensitive silver halide forming component" means a compound that is capable of reacting with the organic silver salt to form a photosensitive silver halide. Whether a particular compound has such ability can be detected by a simple test: a mixture of the organic silver salt and a test compound is subjected to X-ray diffractiometry, optionally after heating, to see if the spectrum has a diffraction peak characteristic of silver halide. Photosensitive silver halide forming components found to be effective by such test are inorganic halides, onium halides, halogenated hydrocarbons, N-halogen compounds and other halogen-containing compounds. Specific examples of such components are given in U.S. Pat. Nos. 4,009,039, 3,457,075 and 4,003,749, British Patent 1,498,956, and Japanese Patent Application (OPI) Nos. 27027/78 and 25420/78. Several examples are set forth below:

(1) inorganic halides: halides of the formula MXn (wherein M is H, $NH_4$ or a metal atom; X is Cl, Br or I; n is 1 when M is H or $NH_4$, and when M is a metal atom, n represents its valence; illustrative metal atoms are lithium, sodium, potassium, cesium, magnesium, calcium, strontium, barium, zinc, cadmium, mercury, tin, antimony, chromium, manganese, iron, cobalt, nickel, rhodium and cerium);

(2) onium halides: quaternary ammonium halides such as trimethylphenyl ammonium bromide, cetylethyldimethyl ammonium bromide, and trimethylbenzyl ammonium bromide; quaternary phosphonium halides such as tetraethylphosphonium bromide; and tertiary sulfonium halides such as trimethyl sulfonium iodide;

(3) halogenated hydrocarbons: iodoform, bromoform, carbon tetrabromide, and 2-bromo-2-methylpropane;

(4) N-halogen compounds: N-chlorosuccinimide, N-bromosuccinimide, N-bromophthalimide, N-bromoacetamide, N-iodosuccinimide, N-bromophthalazone, N-bromoxazoline, N-chlorophthalazone, N-bromoacetanilide, N,N-dibromobenzenesulfonamide, N-bromo-N-methylbenzenesulfonamide, 1,3-dibromo-4,4-dimethylhydantoin, and N-bromourazol; and (5) other halogen-containing compounds: triphenylmethyl chloride, triphenylmethyl bromide, 2-bromoacetic acid, 2-bromoethanol, and dichlorobenzophenone.

These photosensitive silver halide forming components are used in a stoichiometrically small amount with respect to the organic silver salt. The range of such stoichiometrically small amount is generally from about 0.0001 mol to about 0.7 mol, preferably from about 0.01 mol to about 0.5 mol, per mol of the organic silver salt. Two or more photosensitive silver halide forming components may be used on the condition that the sum of their amounts is within the stated range. The reaction temperature, time, pressure and other reaction conditions for the step of using the photosensitive silver halide forming component to convert a part of the organic silver salt to the photosensitive silver halide may be selected from wide ranges depending on the object. The reaction temperature is preferably set in a range of from about −20° C. to about 70° C., the reaction time in range of from about 0.1 second to about 72 hours, and the reaction pressure at atmospheric pressure. The reaction is preferably carried out in the presence of a polymeric binder which is to be described hereinafter. The polymer is generally used in an amount of from about 0.01 to 100 parts by weight, preferably from about 0.1 to 10 parts by weight, per mol of the organic silver salt.

The photosensitive silver halide prepared by any of the methods described above can be chemically sensitized with, for example, a sulfur-containing compound, a gold compound, a platinum compound, a palladium compound, a silver compound, a tin compound, a chromium compound or a mixture thereof. For the procedure of chemical sensitization, see U.S. Pat. No. 4,036,650, British Pat. No. 1,518,850, and Japanese Patent Application (OPI) Nos. 22430/76, 78319/76 and 81124/76. The photosensitive silver halide prepared by conversion from a part of the organic silver salt using the photosensitive silver halide forming component can be sensitized in the presence of an amide compound of low molecular weight as described in U.S. Pat. No. 3,980,482.

The photocatalyst, particularly photosensitive silver halide, used as component (b) can be optically sensitized with a variety of known dyes. Illustrative effective optically sensitizing dyes include cyanine, merocyanine, rhodacyanine, complex (trinuclear or tetranuclear) cyanine or merocyanine, holopolar cyanine, styryl, hemicyanine, oxonol, hemioxonol and xanthene dyes. Preferred cyanine dyes are those having a basic nucleus such as a thiazoline nucleus, an oxazoline nucleus, a pyrroline nucleus, a pyridine nucleus, an oxazole nucleus, a thiazole nucleus, a selenazole nucleus or an imidazole nucleus. Preferred merocyanine dyes are those having both the above stated basic nucleus and an acidic nucleus such as a thiohydantoin nucleus, a rhodanine nucleus, an oxazolidinedione nucleus, a thiazolidinedione nucleus, a barbituric acid nucleus, a thiazolineone nucleus, a malonitrile nucleus or a pyrazolone nucleus. Cyanine and merocyanine dyes having an imino group or a carboxyl group are particularly preferred. Suitable dyes selected from the known dyes described in U.S. Pat. Nos. 3,761,279, 3,719,495 and 3,877,943, British Pat. Nos. 1,466,201, 1,469,117 and 1,422,057 and Japanese Patent Application (OPI) Nos. 27924/76 and 156424/75 may be positioned in proximity with the photocatalyst in accordance with the technique stated in the above prior art references. These optically sensitizing dyes are used in an amount of from about $10^{-4}$ mol to about 1 mol per mol of the photocatalyst, component (b).

The reducing agent used as component (c) of this invention reacts with the organic silver salt to reduce it when heated to a temperature of at least 80° C. in the presence of an exposed photocatalyst. The agent functions in a heat developable photosensitive material as an image forming composition that enters into an oxidation-reduction reaction with the organic silver salt. A suitable reducing agent is determined in consideration of the type and properties of the organic silver salt used. For an organic silver salt that is not easily reducible, a strong reducing agent is suitable, whereas for a easily reducible organic silver salt, a weak reducing agent is suitable.

Common reducing agents for use in a heat developable photosensitive material include monophenols, polyphenols having two or more phenol groups, mononaphthols, bisnaphthols, polyhydroxybenzenes having two or more hydroxyl groups, polyhydroxynaphthalenes having two or more hydroxyl groups, ascorbic acids, 3-pyrazolidones, pyrazoline-5-ones, pyrazolones, phenylenediamines, reducing sugars, hydroxylamines, hydroquinone monoethers, hydroxamic acids, hydrazides, amidoximes, and N-hydroxyureas. Illustrative specific reducing agents are set forth in U.S. Pat. Nos. 3,615,533, 3,679,426, 3,672,904, 3,751,252, 3,782,949, 3,801,321, 3,794,949, 3,794,488, 3,893,863, 3,887,376, 3,770,448, 3,819,382, 3,773,512, 3,928,686, 3,839,048, 3,887,378, 4,009,039 and 4,021,249, British Pat. No. 1,486,148, Belgian Pat. No. 786,086, Japanese Patent Application (OPI) Nos. 36143/75, 36110/75, 116023/75, 99719/75, 140113/75, 51933/76, 23721/76 and 84727/77, and Japanese Patent Publication No. 35851/76. A suitable reducing agent selected from the list of these known ones is used as component (c) of this invention. The most practical way to select a suitable reducing agent is to first prepare a heat developable photosensitive material using a reducing agent and evaluate its photographic properties thereby indirectly checking the acceptability of the reducing agent used.

Reducing agents preferred for use in combination with silver salts of aliphatic carboxylic acids used as the organic silver salt are polyphenols having two or more phenol groups bonded together by an alkylene group or sulfur atom, particularly those polyphenols having two or more phenol groups bonded together by an alkylene group or sulfur atom and wherein the phenol group is substituted by an alkyl group (e.g., a methyl group, an ethyl group, a propyl group, a tert-butyl group, or a cyclohexyl group) or an acyl group (e.g., an acetyl group or a propionyl group) at one or both of the two substitution positions adjacent to a hydroxyl-substituted position of said phenol group, such as 1,1-bis(2-hydroxy-3,5-dimethylphenyl)-3,5,5-trimethylhexane, 1,1-bis(2-hydroxy-3-tert-butyl-5-methylphenyl)methane, 1,1-bis(2-hydroxy-3,5-di-tert-butylphenyl)methane, 2,6-methylenebis(2-hydroxy-3-tert-butyl-5-methylphenyl)-4-methylphenol, 6,6'-benzylidene-bis-(2,4-di-tert-butylphenol), 6,6'-benzylidene-bis(2-tert-butyl-4-methylphenol), 6,6'-benzylidene-bis(2,4-dimethylphenol), 1,1-bis(2-hydroxy-3,5-dimethylphenyl)-2-methylpropane, 1,1,5,5-tetraquis(2-hydroxy-3,5-dimethylphenyl)-2,4-ethylpentane, 2,2-bis(4-hydroxy-3,5-dimethyl)propane, 2,2-bis(4-hydroxy-3,5-di-tert-butylphenyl)propane, and other polyphenol compounds mentioned in U.S. Pat. Nos. 3,589,903 and 4,021,249, British Pat. No. 1,486,148, Japanese Patent Application (OPI) Nos. 51933/76, 36110/75, 116023/75 and 84727/77, and Japanese Patent Publication No. 35727/76. Other preferred examples of the reducing agent for use in combination with silver salts of aliphatic carboxylic acids are bis-$\beta$-naphthols set forth in U.S. Pat. No. 3,672,904 such as 2,2'-dihydroxyl-1,1-binaphthyl, 6,6'-dibromo-2,2'-dihydroxyl-1,1'-binaphthyl, 6,6'-dinitro-2,2'-dihydroxyl-1,1'-binaphthyl, bis(2-hydroxy-1-naphthyl)methane, and 4,4'-dimethoxy-1,1'-dihydroxy-2,2'-binaphthyl; and sulfonamide phenols or sulfonamide naphthols mentioned in U.S. Pat. No. 3,801,321, such as 4-benzenesulfonamide phenol, 2-benzenesulfonamide phenol, 2,6-dichloro-4-benzenesulfonamide phenol and 4-benzenesulfonamide naphthol.

The amount of the reducing agent used in this invention varies with its type and the type of the organic silver salt, as well as the presence of other additives, and generally it is in the range of from about 0.05 mol to about 10 mols, preferably from about 0.1 mol to about 3 mols, per mol of the organic silver salt. Two or more of the reducing agents illustrated above may be used on the condition that the sum of their amounts is within the indicated range.

The above described components (a), (b) and/or (c) are dispersed in a binder to form a layer, and a variety of known polymeric materials employed in the art of heat developable photosensitive materials may be used as the binder. Illustrative binders are natural polymeric materials such as proteins like gelatin, cellulose derivatives, polysaccharides like dextran, and gum arabic, as well as synthetic polymeric materials described in U.S. Pat. No. 4,009,039, and Japanese Patent Application (OPI) Nos. 126408/75, 29126/76, 19525/76 and 84443/74, such as polyvinyl butyral, polyvinyl acetate, ethyl cellulose, vinylidene chloride-vinyl chloride copolymer, polymethyl methacrylate, vinyl chloride-vinyl acetate copolymer, cellulose acetate butyrate, and polyvinyl alcohol. Hydrophobic synthetic polymeric materials are preferred.

These polymeric materials are used in an amount sufficient to disperse and carry the components (a), (b) and/or (c), namely, in an amount effective for such materials to exhibit their effect as a binder. The range for such amount is suitably determined by those skilled in the art, any by way of illustration, when they are used to disperse and carry at least an organic silver salt, their ratio to the organic silver salt is within the range of from about 10:1 to 1:10, preferably from about 4:1 to 1:4, by weight.

The components (a) thru (c) may be individually dispersed in the binder to form three separate layers. But to provide high sensitivity, the components (a) and (b) must be present in intimate contact with each other and, therefore, the two components are preferably incorporated in the same layer. If this is the case, the component (c) may also be included within the layer that contains the components (a) and (b) or, alternatively, it may be incorporated in a layer adjacent to the layer containing the components (a) and (b).

When the two components (a) and (b) are incorporated in one layer, and the component (c) is incorporated in another, the two layers are strongly bonded to each other by incorporating component (d) of this invention in at least one of the two layers.

When the three components (a) thru (c) are included within the same layer, the layer is strongly bonded to an adjacent auxiliary layer (such as the subbing layer described in U.S. Pat. No. 4,021,229 or the polymer overcoat described in U.S. Pat. No. 3,933,508) by incorporating the component (d) of this invention in at least one of the two layers. As described in detail in the above cited U.S. patents, the subbing layer is disposed between the layer containing the components (a) to (c) and the support and is composed of a polymeric material such as polyvinyl acetate, cellulose acetate, vinyl chloride-acetate copolymer, vinyl chloride-vinylidene chloride copolymer, or polyvinyl alcohol. This layer is generally coated onto the support in a thickness of from about 1 to 20 microns.

The effect of the component (d) to provide good contact between the two layers is conspicuous at the interface between a layer containing the components (a) thru (c) and a polymer overcoat. The polymer overcoat is composed of a variety of polymeric materials as described in U.S. Pat. Nos. 3,933,508 and 3,856,526 such as polyvinyl chloride, polyvinyl acetate, vinyl acetate-chloride copolymer, vinyl chloride-vinylidene chloride copolymer, carboxypolyesters, vinylidene chloride, polystyrene, methyl cellulose, ethyl cellulose, cellulose diacetate, cellulose acetate butyrate, gelatin, and polyvinyl alcohol. The overcoat of such materials is applied to the layer containing components (a) thru (c) to give a thickness of from about 1 to 20 microns. Hydrophobic polymeric materials are preferred as the material for the polymer overcoat. When the component (c) is incorporated in a layer separate from a layer containing the components (a) and (b), the layer containing the component (c) is preferably composed of a polymeric material selected from those suitably used to form the polymer overcoat described above.

Accordingly, the particularly preferred embodiments of this invention are:

(1) a heat developable photosensitive material having disposed on a support a layer containing the components (a) and (b) and a layer containing the component (c), at least one of the two layers further containing the component (d);

(2) a heat developable photosensitive material having disposed on a support a layer containing the components (a) thru (c) and a polymer overcoat, at least one of the two layers further containing the component (d); and (3) a heat developable photosensitive material the same as (1) or (2) above except that a subbing layer is disposed between the support and the layer adjacent it.

The effect of the component (d) to provide improved contact between two adjacent layers is exhibited with high reproducibility by incorporating about 0.1 wt% to 100 wt% of the component (d) on the basis of the binder that forms the layer in which the component is incorporated. The component (d) is preferably used in an amount of from 0.1 wt% to 10 wt% based on said binder. While the effect of the component (d) is not affected by how it is incorporated in a layer, it is preferably added to a coating solution before its application.

The component (d) of this invention provides improved adhesion between two adjacently disposed layers in a heat developable photosensitive material (e.g., a photosensitive, heat-sensitive layer and an overcoat, or photosensitive, heat-sensitive layer and a subbing layer), and it is very effective in preventing delamination without an adverse effect on the other photographic characteristics of the material.

The repeating unit of the following formula of which the polymer serving as component (d) of this invention is composed is hereunder described in further detail:

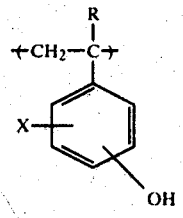

wherein R is a hydrogen atom, or a lower alkyl group having not higher than 4 carbon atoms such as a methyl group, an ethyl group or a propyl group; and X is a hydrogen atom, or 1 to 3 substituents selected from the group consisting of the following:

(i) a halogen atom (e.g., chlorine, bromine or iodine);

(ii) a nitro group;

(iii) a cyano group;

(iv) an alkyl group (straight, branched or cyclic), especially an alkyl group having not higher than 18 carbon atoms, (e.g., tert-butyl group, 1,1,5-trimethylhexyl group, or 1-methylundecyl group);

(v) an alkoxy group, especially an alkoxy group having not higher than 12 carbon atoms, which may be substituted by an aryl group such as a phenyl group or naphthyl group, a hydroxyl group and/or a halogen atom (e.g., methoxy group, ethoxy group, butyloxy group, benzyloxy group, or 1-chloro-2-hydroxypropoxy group);

(vi) an alkoxycarbonyl group (wherein the alkyl moiety can be straight, branched or cyclic), especially an alkoxycarbonyl group having not higher than 12 carbon atoms, which may be substituted by an aryl group such as a phenyl group or naphthyl group (e.g., methoxycarbonyl group, ethoxycarbonyl group, or butoxycarbonyl group);

(vii) an alkylsulfonyl group (wherein the alkyl moiety can be straight, branched or cyclic), especially an alkylsulfonyl group having not higher than 8 carbon atoms (e.g., methylsulfonyl group, propylsulfonyl group or butylsulfonyl group);

(viii) an aryloxy group (wherein the aryl moiety can be mono- or bicyclic), especially an aryloxy group having not higher than 12 carbon atoms (e.g., phenoxy group, or naphthoxy group);

(ix) an acyl group (wherein the acyl group can be aliphatic or aromatic, saturated or unsaturated), especially an acyl group having not higher than 12 carbon atoms, which may be substituted with a halogen atom or an aryl group such as a phenyl group or a naphthyl group (e.g., acetyl group, propionyl group, chloroacetyl group, or benzoyl group);

(x) an acyloxy group (wherein the acyl group can be aliphatic or aromatic, saturated or unsaturated), especially an acyloxy group corresponding to the above illustrated acyl group (e.g., acetyloxy group, propionyloxy group, chloroacetyloxy group or benzoyloxy group); and (xi) an acylamido group (wherein the acyl group can be aliphatic or aromatic, saturated or unsaturated), especially an acylamido group corresponding to the above illustrated acyl group (e.g., acetylamido group, propionylamido group or chloroacetylamido group).

Of the groups (i) to (xi) above, a halogen atom, a nitro group, an alkyl group and an alkoxy group are preferred because of the easy availability of the polymer, and in the most preferred component (d) X is a hydrogen atom.

The effect to prevent delamination is invariably obtained with polymers having at least five repeating units of the formula defined above, but since a further increase in the number of the units will not be reflected in a corresponding change in the effect, the maximum number of the units may be determined by such factors as availability of the polymer, ease of its synthesis, and ease of handling of the same. For the purposes of this invention, a polymer preferred in practice has about 5 to about 200 repeating units of the formula defined above. A particularly preferred polymer has about 7 to 60 such repeating units. The effect of the component (d) is in no way affected even if the polymer contains a small amount of monomer or dimer.

A part of the hydroxyl groups contained in the polymer having repeating units of the above formula may be modified to alkoxy groups, aryloxy groups or acyloxy groups, wherein the alkoxy group, aryloxy group and acyloxy group are defined as in (v), (viii) and (x), respectively, in connection with the description of the group X.

The component (d) of this invention may be a copolymer having the above defined units as well as a copolymer containing other copolymerizable components, such as acrylic acid; methacrylic acid; acrylic or methacrylic esters (e.g., methyl acrylate, ethyl methacrylate, butyl acrylate and 2-ethylhexyl methacrylate); acrylic acid amides or methacrylic acid amides (such as acrylamide, methacrylamide, N-butylacrylamide, N,N-dibutylacrylamide); maleic anhydride; half esters, diesters, half amides, diamides or imides of maleic anhydride; styrenes; vinyl imidazoles; acrylonitrile; and butadiene. These copolymers preferably contain at least 5 mol% of a unit of the formula defined above. It is particularly preferred that these copolymers contain at least 30 mol% of the unit. When a copolymer contains acidic copolymerizable components such as acrylic acid, methacrylic acid and styryl sulfonic acid, it is preferred that the copolymer contains not more than 30 mol% of these components.

Illustrative preferred polymers for use as the component (d) of this invention are set forth below (the symbol Mw used in the formulae represents the average molecular weight):

1. 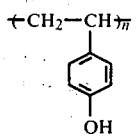
wherein n ≈ 40

2. 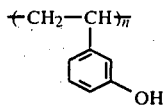
wherein n ≈ 15

3. 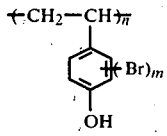
wherein n ≈ 10, m ≈ 1.5

4. 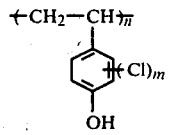
wherein n ≈ 50, m ≈ 1.6

5. 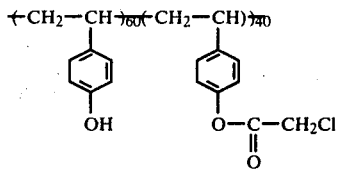
wherein Mw ≈ 6,000

6. 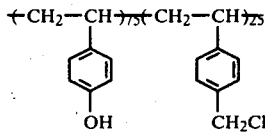
wherein Mw ≈ 12,800

7. 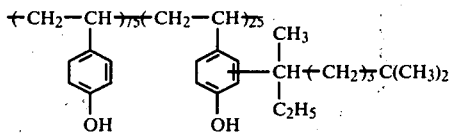
wherein Mw ≈ 3,100

8. 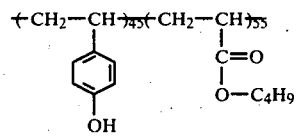
wherein Mw ≈ 24,000

9. 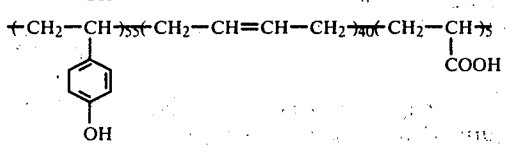
wherein Mw ≈ 1,800

10. 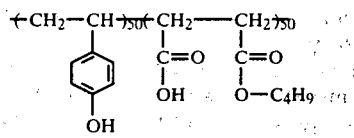
wherein Mw ≈ 2,900

11. 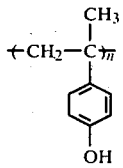
wherein n ≈ 8

-continued

12. 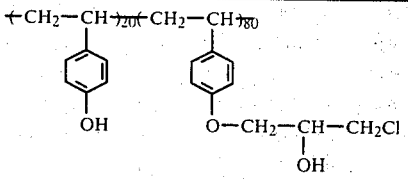

wherein Mw ≈ 3,600

13. 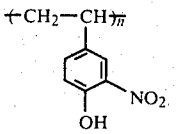

wherein n ≈ 10

The polymers described above can be synthesized by a known method, for instance, they are readily synthesized by the polymerization technique described in *Journal of Polymer Science,* A-1, Vol. 7, pp. 2175 and 2405, 1969 and other references from monomers that can be synthesized by the method described in *Journal of Organic Chemistry,* Vol. 23, pp. 544–549, 1958. Some of the polymers described above are commercially available. For example, polymer 1 in the above list is available from Maruzen Oil Co., Ltd. under the trade name "Resin M", and polymer 3 is available from the same company under the trade name "Resin MB". These commercial products may be used to achieve the objects of this invention.

The components (a) thru (d) of this invention are desirably used in combination with a toner, a tone imparting agent or activator toner (which are hereunder collectively referred to as a toner). The toner enters into the process of the oxidation-reduction reaction between the organic silver salt and reducing agent for the formation of a silver (image), and its function is to provide an image of increased density, especially a darkened image. A great many numbers of compounds are known as toners, and most of them contain an imino group, a mercapto group or a thion group. A suitable toner is selected from these known compounds depending on the type of the organic silver salt and reducing agent used. Compounds preferred for the purposes of this invention include the phthalazinones described in U.S. Pat. Nos. 3,152,904, 3,844,797, and 4,076,534 (such as phthalazinone, 2-acetylphthalazinone, and 2-carbamoylphthalazinone); the 2-pyrazoline-5-ones described in U.S. Pat. No. 3,846,136 (such as 3-methyl-2-pyrazoline-5-one) or quinazolinones described in the same reference (such as quinazolinone and 4-methylquinazolinone); the pyrimidines described in U.S. Pat. No. 4,030,930 (such as 6-methyl-2,4-dihydroxypyrimidines) or 1,2,5-triazines described in the same reference (such as 3-methyl-4,6-dihydroxyl-1,2,5-triazine); the phthalazinediones described in Japanese Patent Publication No. 36774/78 (such as phthalazinedione); and heterocyclic compounds having an imino group such as cyclic imides (for example, the succinimides, phthalimides or urazols described in U.S. Pat. No. 3,846,136 and Japanese Patent Application (OPI) No. 55115/78, the benzoxazinediones described in U.S. Pat. Nos. 3,951,660 and 3,885,967, the benzothiazinediones described in Japanese Patent Application (OPI) No. 76020/78, and the naphthalimides described in U.S. Pat. No. 3,782,941). Two or more of these toners may be used as described in Japanese Patent Application (OPI) Nos. 1020/78 and 55115/78 wherein a phthalazinone is combined with a benzoxazinedione, benzothiazinedione or phthalimide. One advantage of such combination is that it prevents an unwanted change in the tone effect occurring upon storage under hot and humid conditions.

Alternatively, as described in U.S. Pat. Nos. 3,847,612 and 3,994,732, the toner may comprise phthalic acid, naphthoic acid or phthalamic acid in combination with an imidazole or phthalazone.

The use of the toner is optional, and if it is used, its content is in the range of from about 0.0001 mol to about 2 mols, preferably from about 0.0005 mol to about 1 mol, per mol of the organic silver salt. The toner may be incorporated in any layer of the composition of this invention, and it is preferably included within a layer containing the components (a) and (b), or a layer containing the components (a) thru (c).

The components of the heat developable photosensitive material of this invention may be used in combination with known compounds in the art that are effective in preventing discoloration of a processed material by light. Examples of such compounds are a stabilizer precursor such as azole thioether or blocked azole thions of the type described in U.S. Pat. No. 3,839,041; a tetrazolyl compound or a precursor therefor of the type described in U.S. Pat. No. 3,700,457; a halogen-containing compound of the type described in U.S. Pat. Nos. 3,707,377, 3,874,946 and 3,955,982; and the elemental sulfur described in Japanese Patent Application (OPI) No. 26019/76.

The heat developable photosensitive composition of this invention may also contain a compound effective in preventing the formation of fog (known as heat fog) in an unexposed area during heat development. Many compounds are known as anti-heat foggants and illustrative compounds are the mercury compound described in U.S. Pat. No. 3,589,903; the N-halogeno compound described in U.S. Pat. No. 3,957,493; benzenethiosulfonic acids of the type described in Japanese Patent Application (OPI) No. 78227/76; sulfinic acids of the type described in Japanese Patent Application (OPI) No. 122430/76; cerium compounds of the type described in Japanese Patent Application (OPI) No. 24520/77. Other examples of the anti-heat foggant are illustrated in Japanese Patent Application (OPI) Nos. 101019/75, 116024/75, 123331/75, 134421/75, 47419/76, 42529/76, 51323/76, 57435/76, 104338/76, 32015/78, 22431/76, 54428/76, 75433/76, 122430/76, 1020/78, 19825/78 and 28417/78. These anti-heat foggants are used independently or as a mixture.

The layer(s) containing the essential components of this invention or each of the auxiliary layers may contain additives known in the art of heat developable photosensitive materials, such as a plasticizer, matting agent, surfactant, sensitizer, bleaching agent, light-absorptive material, filter dye, antihalation dye, color coupler, hardener, lubricant and development accelerator. For the specific names of these additives and embodiments of their use, see *Product Licensing Index*, Vol. 92, December 1971, No. 9232, page 107, Japanese Patent Application (OPI) Nos. 33615/78, 119623/75, 57619/75 and 27923/76, and U.S. Pat. Nos. 3,769,019, 3,821,001, 3,667,959, 3,871,887, 3,885,965, 4,021,250, 4,036,650, 3,531,286, and 3,764,328.

The laminated structure of this invention is retained on a support that is composed of a variety of polymeric materials, glass, wool cloth, cotton cloth, paper and metal such as aluminum, and since the composition of this invention is used as an information recording material, an advantageous material for the support is such that it can be processed into a flexible sheet or roll. Therefore, preferred supports for use in this invention include plastic films such as cellulose acetate film, polyester film, polyethylene terephthalate film, polyamide film, polyimide film, triacetate film and polycarbonate film; paper including photographic raw paper, printing paper such as coated paper or art paper, baryta paper, resin coated paper, paper sized with polysacchardie of the type described in Belgian Pat. No. 784,615, pigment paper containing a pigment such as titanium dioxide, and paper sized with polyvinyl alcohol.

Such support is coated with layers or auxiliary layers by a conventional technique such as immersion coating, air knife coating, hopper coating or curtain coating. They may be applied in single layer or two or more layers may be applied simultaneously.

The thus prepared heat developable photosensitive material is cut into a suitable size before it is subjected to imagewise exposure. If necessary, it may be preliminarily heated (at 80° to 140° C.) before exposure. Light sources suitable for imagewise exposure are a tungsten lamp, a copying fluorescent lamp of the type primarily used for exposure of diazo photosensitive materials, mercury lamp, iodine lamp, xenon lamp, cathode ray tube (CRT), and a laser. The original may be a line image such as of drawings or a photographic image having a gradation. Instead, the heat developable photosensitive material of this invention may be set in a camera and used to take a picture of a man or scene. Printing methods include contact printing, reflex printing and enlarging printing.

The exposure required depends on the sensitivity of the photosensitive material, and it is about 10 lux. sec. for high-sensitivity materials and about $10^3$ lux. sec. for low-sensitivity material. The material thus exposed is simply heated (at about 180° C., preferably between about 100° and about 150° C.) to provide a developed recording image having good contrast. The heating time is freely controlled within the range of from 1 second to 60 seconds, and the exact heating time is determined by its correlation with the heating temperature. Generally, heating suitably continues for a period of from about 5 seconds to about 40 seconds at 120° C., from about 2 seconds to about 20 seconds at 130° C., and from about 1 to about 10 seconds at 140° C. Various heating means may be employed, such as a simple heated plate or drum with which a heat developable sensitive material is brought into contact, a heated space through which the sensitive material is caused to pass, high-frequency heating, or even laser beams.

Because of the effect of the component (d), the heat developable photosensitive material of this invention has improved contact between each layer of the material, and it is free from delamination that would occur during storage, heat development or use after processing. Therefore, the material keeps a clean copying surface, adding to the commercial value of the material.

This invention is now described in greater detail by reference to the following examples which are given here for illustrative purposes only and are by no means intended to limit the scope of the invention.

EXAMPLE 1

A mixture of 34 g of behenic acid and 500 ml of water was heated to 85° C. to make a solution. The solution of behenic acid in water was stirred at 1,800 rpm while an aqueous solution of sodium hydroxide (2.0 g of sodium hydroxide + 50 cc of water) was added at 25° C. over a period of 3 minutes to form a mixture of sodium behenate and behenic acid. Then, the mixture was stirred at 1,800 rpm while its temperature was lowered from 85° C. to 30° C.

With continued stirring, an aqueous solution of silver nitrate (8.5 g of silver nitrate + 50 cc of water) was added at 25° C. over a period of 3 minutes, followed by stirring for another 90 minutes. To the mixture, 200 cc of isoamyl acetate was added and the grains of the resulting silver behenate were recovered. The recovered silver behenate was dispersed uniformly in a solution of polyvinyl butyral in isopropanol (25 g of Denka Butyral 4000-2 manufactured by Denki Kagaku Kogyo K.K. + 200 cc of isopropanol) with a homogenizer (25° C., 3,000 rpm, 30 minutes) to prepare a dispersion of silver behenate in polymer.

The dispersion was held at 50° C. under stirring at 500 rpm while a solution of N-bromosuccinimide in acetone (1.4 g of N-bromosuccinimide + 100 cc of acetone) was added at 25° C. over a period of 40 minutes, followed by stirring for another 60 minutes to prepare composition A for heat developable photosensitive material (dispersion of silver bromide-silver behenate in polymer).

A twelfth (1/240 mol) of composition A was held at 30° C. under stirring at 200 rpm while the following components were added sequentially at a 5 minute interval to prepare coating solution A.

(i) Sensitizing dye (a merocyanine dye of the following formula)

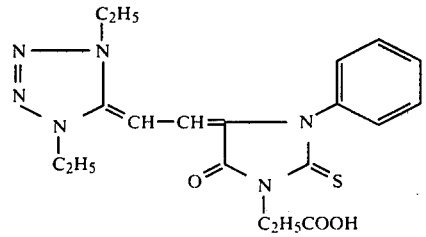

(0.025 wt % solution in methyl cellosolve) 2 ml (ii) Sodium benzenethiosulfonate (0.01 wt % solution in methanol) 2 ml (iii) Phthalazinone (4.5 wt % solution in methyl cellosolve) 5 ml (iv) Reducing agent (o-bisphenol of the following formula)

-continued

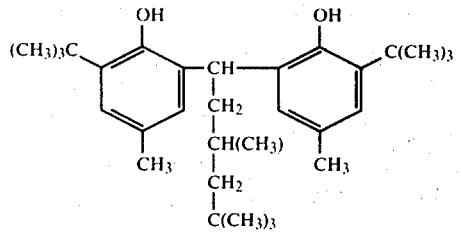

(10 wt % solution in acetone) 10 ml

Coating solution A was applied to a support paper (raw paper for pressure-sensitive paper subbed with polyvinyl alcohol) to provide heat developable photosensitive material (A) coated with 0.3 g of silver per square meter.

Heat developable photosensitive material (A) was coated with a polymer overcoat (hereunder referred to as a protective layer) which was applied in an amount of 40 ml/m$^2$ from a solution of 0.5 g of component (d) or poly-p-vinyl phenol ("Resin M" manufactured by Maruzen Oil Co., Ltd.) in a cotton acetate solution comprising 5 g of cellulose diacetate and 200 cc of acetone. The product was heat developable photosensitive material (B).

As a control, heat developable photosensitive material (C) was prepared which was the same as (B) except that the overcoat consisted of only 40 ml/m$^2$ of a cotton acetate solution.

The thus prepared heat developable photosensitive materials (B) and (C) were exposed to a tungsten lamp through an optical wedge. The exposed materials were then heat-developed by holding them in contact with a hot plate (130° C.) for a period of 8 seconds.

The closeness of contact between the overcoat and the layer underneath of each heat-developed sample was checked by the following method: adhesive tape (a polyester adhesive tape manufactured by Nitto Electric Industrial Co., Ltd.) was applied to the surface of each sample, then it was separated from the sample by pulling it back at an angle of 180 degrees with the sample, and the area of the sheet of cotton acetate coming with the tape was measured.

TABLE 1

| Sample | Relative Value of Cotton Acetate Coming with the Adhesive Tape |
|---|---|
| (B) | 5 |
| (C) | 100 |

The above test revealed that component (d) or poly-p-vinyl phenol of this invention is effective in providing intimate contact between layers.

EXAMPLE 2

Heat developable photosensitive material (D) was prepared from the same formulation as Example 1 except that the component (d) was brominated poly-p-vinyl phenol ("Resin MB" manufactured by Maruzen Oil Co., Ltd.). The sample was subjected to the same test as in Example 1 with sample (C) used as the control.

TABLE 2

| Sample | Relative Value of Cotton Acetate Coming with the Adhesive Tape |
|---|---|
| (D) | 5 |
| (C) | 100 |

The above results show that brominated poly-p-vinyl phenol contained in the component (d) of this invention is effective in providing intimate contact between layers.

EXAMPLE 3

A twelfth (1/240 mol) of composition A was held at 30° C. under stirring at 200 rpm while the components (i) thru (iv) of Example 1 were added sequentially at 5 minute intervals. Finally, component (v) consisting of 2 ml of poly-p-vinyl phenol (10 wt% solution in isopropyl alcohol) was added to form coating solution E. It was applied to a support paper (raw paper for pressure-sensitive paper subbed with polyvinyl alcohol) to provide heat developable photosensitive material (E) coated with 0.3 g of silver per square meter. As a control, heat developable photosensitive material (A) was prepared.

Samples (E) and (A) were coated with 40 ml/m$^2$ of cotton acetate solution to make heat developable photosensitive materials (E) and (C), which were subjected to the same test as in Examples 1 and 2.

TABLE 3

| Sample | Relative Value of Cotton Acetate Coming with the Adhesive Tape |
|---|---|
| (E) | 10 |
| (C) | 100 |

The above results show that component (v) incorporated as an essential component of this invention was effective in providing intimate contact between the layers.

EXAMPLE 4

A heat developable photosensitive material (F) was prepared from the same formulation as Example 3 except that the component (v) was brominated poly-p-vinyl phenol. The sample was subjected to the same test as in Example 3 with sample (C) used as the control.

TABLE 4

| Sample | Relative Value of Cotton Acetate Coming with the Adhesive Tape |
|---|---|
| (F) | 5 |
| (C) | 100 |

EXAMPLE 5

The component (d) of this invention in no way deteriorates the photographic properties of a heat developing photosensitive material containing it, as will be understood from Table 5 below that sets forth the photographic properties of the heat developable photosensitive materials (B) thru (F) prepared in Examples 1 thru 4.

TABLE 5

| Sample | Component (d) | Incorporated in | Fresh*1 $D_{max}$ | Fresh*1 Fog | Fresh*1 Sensitivity*3 | After Forced Deterioration*2 $D_{max}$ | After Forced Deterioration*2 Fog | After Forced Deterioration*2 Sensitivity*4 |
|---|---|---|---|---|---|---|---|---|
| C | None | — | 1.25 | 0.07 | 100 | 1.20 | 0.11 | 100 |
| B | Resin M | Protective layer | 1.27 | 0.08 | 105 | 1.22 | 0.06 | 95 |
| D | Resin MB | Protective layer | 1.26 | 0.07 | 103 | 1.15 | 0.11 | 100 |
| E | Resin M | Photo-sensitive layer | 1.26 | 0.08 | 100 | 1.28 | 0.09 | 95 |
| F | Resin MB | Photo-sensitive layer | 1.26 | 0.08 | 100 | 1.18 | 0.12 | 105 |

*1Values for samples (C) to (F) that were exposed and heat-developed immediately after their preparation.
*2Values for samples (C) to (F) that were exposed and heat-developed after 3 day storage at 350° C. and 85% RH.
*3The reciprocal of an exposure that provides a reflection density of Fog + 0.5. Relative to the value for fresh (C) which is 100.
*4The reciprocal of an exposure that provides a reflection density of Fog + 0.5. Relative to the value for forcedly deteriorated (C) which is 100.

While the invention has been described in detail and with reference to specific embodiments thereof, it will be apparent to one skilled in the art that various changes and modifications can be made therein without departing from the spirit and scope thereof.

What is claimed is:

1. A heat developable photosensitive material having two or more polymeric binder layers superposed on a support and containing at least (a) an organic silver salt, (b) a photocatalyst and (c) a reducing agent in one or more said layers, at least one of said layers containing as an additive, in an amount sufficient to improve contact between said layers, (d) a polymer having about 5 to 200 repeating units of the formula:

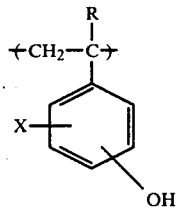

(A)

wherein R is a hydrogen atom or a lower alkyl group; and X is a hydrogen atom, or one to three groups selected from the class consisting of a halogen atom, a nitro group, a cyano group, an alkyl group, an alkoxy group, an alkoxycarbonyl group, an alkylsulfonyl group, an aryloxy group, an acyl group, an acyloxy group and an acylamido group.

2. The heat developable material of claim 1, wherein said polymer (d) consists of repeating units of the defined formula.

3. The heat developable material of claim 1, wherein said polymer comprises repeating units other than those falling within the defined formula and being copolymerizable with the repeating unit of the formula (A).

4. The heat developable material of claim 3, wherein said copolymer comprises at least 5 mol% repeating units of the defined formula.

5. The heat developable material of claim 1, which contains about 7 to 60 repeating units of the defined formula.

6. The heat developable material of claim 1, wherein said organic silver salt (a) and said photocatalyst (b) are present in the same layer.

7. The heat developable material of claim 6, wherein said reducing agent is in a layer adjacent said layer containing (a) and (b).

8. The heat developable material of claim 7, wherein said polymer (d) is present in at least one of said adjacent layer or said layer containing (a) and (b).

9. The heat developable material of claim 1 comprising a polymeric subbing layer wherein at least one of said subbing layer or said layer or layers containing components (a), (b) and (c), contains said polymer (d).

10. The heat developable material of claim 1, which comprises a polymeric protective layer and at least one of said protective layer and said layer containing components (a), (b) and (c) contains said polymer (d).

11. The heat developable material of claim 1, wherein X is a halogen atom, an alkyl group, a nitro group, or an alkoxy group.

12. The heat developable material of claim 1, wherein X is hydrogen.

* * * * *